US005556728A

United States Patent [19]

Nogami et al.

[11] Patent Number: 5,556,728

[45] Date of Patent: Sep. 17, 1996

[54] PHOTOCONDUCTOR ELEMENT OF AN ELECTROPHOTOGRAPHIC DEVICE

[75] Inventors: Sumitaka Nogami; Hideki Kina; Kaneyuki Mantoku, all of Nagano, Japan

[73] Assignee: Fuji Electric Co., Ltd., Tokyo, Japan

[21] Appl. No.: 204,603

[22] Filed: Feb. 28, 1994

[30] Foreign Application Priority Data

Mar. 1, 1993 [JP] Japan ..... 5-039140
Jun. 15, 1993 [JP] Japan ..... 5-142415

[51] Int. Cl.[6] ..... G03G 15/04
[52] U.S. Cl. ..... 430/64; 430/62
[58] Field of Search ..... 430/64, 62

[56] References Cited

U.S. PATENT DOCUMENTS 4,954,406 9/1990 Endo et al. ..... 430/60
5,278,014 1/1994 Tamaki et al. ..... 430/58

FOREIGN PATENT DOCUMENTS 2-222965 9/1990 Japan .

*Primary Examiner*—George F. Lesmes
*Assistant Examiner*—Laura Weiner
*Attorney, Agent, or Firm*—Brumbaugh, Graves, Donohue & Raymond

[57] ABSTRACT

An electrophotographic photoconductor having superior electrical properties and image quality which are not affected by the external environment is provided. The photoconductor includes an intermediate layer formed between a conductive substrate and a photosensitive layer. The intermediate layer is a hardened film containing as its main components melamine resin, aromatic carboxylic acid and/or aromatic carboxylic anhydride, and fixed iodine. Alternatively, the intermediate layer is composed of normal-butylated melamine resin, acid and/or an acid equivalent, and fixed iodine. The film thickness of the intermediate layer according to the present invention need not be as thin as in the prior art. An intermediate layer of such a thickness can cover various defects on the surface of the conductive substrate, and a uniform photosensitive layer with few film defects can be formed on the intermediate layer. In particular, even in the case of a photoconductor with a photosensitive layer composed of a charge-transfer layer laminated on a charge-generation layer, a thin-film, charge-generation layer can be easily formed without experiencing non-uniform film growth.

12 Claims, No Drawings

PHOTOCONDUCTOR ELEMENT OF AN ELECTROPHOTOGRAPHIC DEVICE

BACKGROUND OF THE INVENTION

The present invention relates to an electrophotographic element and, more particularly, to an electrophotographic photoconductor that includes a novel intermediate layer and exhibits superior and stable image quality characteristics.

Until recently, an electrophotographic photoconductor element (hereinafter also referred to as a "photoconductor") used in conjunction with the electrophotographic device invented by Carlson generally utilized inorganic photoconductive materials such as selenium, a selenium alloy, zinc oxide, or cadmium sulfide. In recent years, however, many photosensitive elements using organic photoconductive materials have been developed with the aim of taking advantage of their non-noxiousness, good film forming capability, light weight, and low cost.

Of particular interest has been the development of laminated organic photoconductors with a photosensitive layer divided into function-specific layers (hereinafter also referred to as "function-separated, laminated photoconductors"), namely a charge-generation layer that receives light to generate charge carriers, and a charge-transfer layer that transfers generated charge carriers. Many such photoconductors have been developed and used in conjunction with electrophotographic devices such as copying machines, printers, and facsimile machines because such photoconductors offer many advantages. For example, individual function layers can be separately formed of the materials best suited for the desired functions and later combined, thereby substantially increasing the device sensitivity. In addition, spectral sensitivity can be improved depending upon the wavelength of the exposure light.

Most function-separated, laminated organic photoconductors that have been practically applied include a photosensitive layer composed of a charge-transfer layer on top of a charge-generation layer, which in turn is laminated on a conductive substrate. The initial step in manufacturing such a photoconductor is sublimating and depositing an organic charge-generation material on a conductive substrate to form a charge-generation layer. Alternatively, the charge-generation layer may be made by coating, and later drying, the conductive substrate with a coating liquid that is made by dispersing and dissolving an organic charge-generation material and a binder in an organic solvent. Subsequently, a charge-transfer layer is formed by applying, and later drying, a coating liquid that is made by dissolving an organic charge-transfer material and a binder in an organic solvent.

Fundamentally, such a configuration for a photosensitive layer satisfies the basic requirements of a photoconductor for image formation. However, in a practical context, it is important to ensure good images with minimal defects, and good image quality must be maintained over long periods of repeated use. Thus, the photosensitive layer should be a homogeneous, defect-free film having superior electrical properties, and the film quality and the electrical properties should not deteriorate or become unstable after long periods of use.

As is well known to those skilled in the art, it is desirable that the charge carriers generated by the charge-generation layer be able to move fast and be fed into the conductive substrate or the charge-transfer layer instead of being recombined with free electrons and disappearing or being trapped. Thus, the charge-generation layer should preferably be as thin as possible, and currently available photoconductors usually incorporate a charge-generation layer with a thickness in the order of submicrons. However, because the charge-generation layer is formed as such a thin film, contamination, irregularities in shape, and roughness of the surface of the conductive substrate directly result in irregularities in the charge-generation layer. The irregularities in turn cause image defects such as voids, black points, or non-uniform density.

Typically, an aluminum alloy cylinder or a cylinder which has a surface that has been smoothed by cutting and polishing may be used as the conductive substrate. However, the surface roughness of the substrate, contamination of the surface, dispersion of the amount or size of deposits of the metal contained as the alloy component, and surface irregularities caused by the dispersion of the oxidation of the surface result in non-uniform film formation in the charge-generation layer formed on the surface. This result substantially reduces the quality of the images obtained.

In order to avoid such irregularities in the film, and in order to obtain a "blocking effect," which prevents a decrease in the charge-retaining capability of the photoconductor caused by positive holes injected from the conductive substrate when needed, an intermediate layer of an N-type resin with a low electric resistance has been provided on the surface of the conductive substrate as a solution. Resins such as solvent-soluble polyamide, polyvinylalcohol, polyvinylbutyral, or casein have long been used to form the intermediate layer for the above-described reasons. With such resins, even very thin films, for example, films of 0.1 μm or less, can adequately provide a blocking layer effect, provided that no other function is required of the resin.

However, if the resin layer is to serve other functions, e.g., covering the irregular contour and smoothness of the surface of the conductive substrate, and preventing non-uniform distribution of the charge-generation coating liquid to avoid non-uniform film formation, a film thickness of 0.5 μm or more is required. In some cases, a thickness of several tens of μm is required depending upon the machining conditions of the substrate and the contamination of the surface. If a resin layer of such a thickness is formed of polyvinylalcohol, solvent-soluble polyamide, or casein, however, the residual potential is increased and the electrical properties of the photoconductor is subject to change as a function of changes in temperature and humidity. This problem occurs because the resin layer is characterized by high water absorption, and the electrical conductivity of the resin layer is easily changed by the moisture contained in the layer since conductivity mainly depends upon ion conduction, i.e., the movement of H or OH ions resulting from the dissociation of the water molecules in the layer.

Various materials having a low electrical resistance have been proposed for use as the intermediate layer in a photoconductor which is substantially unaffected by changes in the external environment. For example, Japanese KOKAI 2-193152, Japanese KOKAI 3-288157, and Japanese KOKAI 4-31870 disclose the chemical structures of solvent-soluble polyamide resin to be used as the intermediate layer. Japanese KOKOKU 2-59458, Japanese KOKAI 3-150572, and Japanese KOKAI 2-53070 disclose methods for adding an additive to polyamide resin to prevent any change in the electric resistance as a function of a change in environment. In addition, Japanese KOKAI 3-145652, Japanese KOKAI 3-81778, and Japanese KOKAI 2-281262 disclose methods for mixing polyamide resins with other resins to adjust the electrical resistance and to reduce the electrical resistance's susceptibility to change as a function of change in the environment. However, because these methods teach the use of polyamide resin as the principal material, the effects of temperature and humidity levels cannot be completely avoided.

Other previously disclosed methods include using cellulose dielectrics (Japanese KOKAI 2-238459), polyetherurethane (Japanese KOKAI 2-115858 and Japanese KOKAI 2-280170), polyvinylpyrrolidone (Japanese KOKAI 2-105349), or polyglycolether (Japanese KOKAI 2-79859) as the intermediate layer. Alternatively, the use of a cross-linked resin has been proposed to prevent the amount of moisture in the resin layer from being affected by a change in the environment. Furthermore, methods using melamine resin (Japanese KOKAI 4-22966, Japanese KOKOKU 4-31576, and Japanese KOKOKU 4-31577) or phenol resin (Japanese KOKAI 3-48256) are also known. However, effectiveness of such methods are limited by the fact that, when the required resin layer is relatively thick, for example, several μm, the resistance and the residual potential are increased.

One method for counteracting the above-mentioned drawback is to utilize electron-conduction device physics instead of ion-conduction device physics in connection with the material forming the intermediate layer. One of the methods based on this idea is a method that provides a resin layer by dispersing conductive powder such as tin oxide or indium oxide (Japanese KOKOKU 1-51185, Japanese KOKOKU 2-48175, Japanese KOKOKU 2-60177, and Japanese KOKOKU 2-62861). However, if this method is used, it is difficult to make a resin coating liquid having uniformly dispersed conductive powder while stably preserving the coating liquid without having the conductive powder separate or settle. Furthermore, very small protrusions on the surface of the coated resin layer are often caused by the separation and agglomeration of the conductive powder. Such protrusions cause defects in images provided by the photoconductors.

Yet another known method involves using an organic metal compound instead of conductive powder to form a coating liquid. In this method, as disclosed in Japanese KOKOKU 3-4904 and Japanese KOKAI 2-59767, the organic metal compound and resin are dissolved in an organic solvent in order to form an intermediate layer. However, the coating liquid used in this method is unstable, and many additional problems must be solved before this method can be applied practically to mass production.

Given the above problems associated with using a resin layer as the intermediate layer provided on the conductive substrate, it is the object of this invention to provide a photoconductor that has superior electrical properties and superior image quality which are substantially unaffected by environmental factors, while facilitating high productivity.

SUMMARY OF THE INVENTION

According to one embodiment of this invention, the above-mentioned problems are solved by providing an electrophotographic photoconductor having a photosensitive layer formed on an intermediate layer which has been in turn formed on a conductive substrate. The intermediate layer is a hardened film containing as its main components melamine resin, aromatic carboxylic acid and/or aromatic carboxylic acid anhydride, and iodine fixed thereto.

According to another embodiment of the present invention, the intermediate layer is a hardened film containing as its main components normal-butylated melamine resin, acid and/or an acid equivalent, and iodine fixed thereto. Such acid equivalents include acid anhydride of organic carboxylic acid, ammonium salt of organic carboxylic acid, ammonium salt of organic sulfonic acid, ammonium salt of organic phosphoric acid, ammonium salt of sulfuric acid, ammonium salt of phosphoric acid, ammonium salt of hydrochloric acid, aluminum trichloride, boron trifluoride, tri-methylated boron and zinc tetrachloride.

By mixing melamine resin with aromatic carboxylic acid and/or aromatic acid anhydride (hereinafter also simply referred to as an "aromatic carboxylic (anhydride)") and adding iodine to the resultant material to provide a hardened film to act as an intermediate layer, or by providing an intermediate layer which is a hardened film containing as its main components normal-butylated melamine resin, acid and/or an acid equivalent, as well as iodine fixed thereto, a superior photoconductor can be obtained which is very thin and has a low residual potential when formed as a film with a film thickness of, for example, 10 to 20 μm. Such a film would be free of problems such as a decrease in the charging property and an increase in the residual potential resulting from repeated use.

In addition, such a photoconductor would have electrical properties and image quality which will be significantly more stable over a broad range of environmental conditions in comparison with a photoconductor having an intermediate layer formed by simply hardening melamine resin by means of aromatic carboxylic acid (anhydride) or an intermediate layer containing normal-butylated melamine resin and acid (equivalent) as its main components.

The film thickness of the intermediate layer according to the present invention need not be as thin as in the prior art. Even if the film thickness is increased by one order of magnitude over the previously accepted maximum threshold, an electrophotographic photocondutor having superior and stable electrical properties and image quality which are substantially unaffected by the external environment can be obtained.

An intermediate layer of such a thick film can cover various defects on the surface of the conductive substrate, and a uniform photosensitive layer with few film defects can be formed on the intermediate layer. In particular, even in the case of a photoconductor having a photosensitive layer consisting of a charge-transfer layer laminated on a charge-generation layer, a thin-film, charge-generation layer can be easily formed without encountering non-uniform film growth.

DETAILED DESCRIPTION OF THE INVENTION

As described in 21 J. of Mat. Sci. 604–610 (1986), it is well known that adding as much as 80 to 100% iodine to nylon-6 results in conductivity with very low resistance. It is also known that polyvinylalcohol, polytetrahydrofuran, poly (N-vinylpyrrolidone), poly (4-vinylpyridine), and polyacrylonitrile can form an additive compound when provided with iodine, thereby forming a conductive film.

However, the inventors discovered that a hardened material formed from melamine resin, aromatic carboxylic acid (anhydride) and iodine, which makes the resultant material conductive, or a hardened material formed from normal-butylated melamine resin, acid (equivalent) and iodine, functions very effectively as an intermediate layer for a photoconductor.

The melamine resin referred to above is formed by reacting melamine with formaldehyde to provide a methylol compound, and butyletherifying the compound using butanol or isobutanol. Alternatively, this melamine resin is made by reacting melamine with formaldehyde to obtain a methylol compound, followed by normal-butylating the compound using normal-butanol.

Typical aromatic carboxylic acids or aromatic carboxylic anhydrides include terephthalic acid, isophthalic acid, phthalic anhydride, trimellitic acid, trimellitic anhydride, pyromellitic acid, pyromellitic anhydride, and naphthalene carboxylic acid.

The total amount of aromatic carboxylic acid (anhydride) added to the melamine resin should preferably be 5 to 100 parts in weight (hereinafter abbreviated as "pts. wt.") aromatic carboxylic acid (anhydride) per 100 pts. wt. melamine resin. If the amount added is less than 5 pts. wt., the hardness of the film will be reduced, thereby resulting in reduced solvent resistance, and problems such as swelling or dissolution of the film will occur when a charge-generation layer is subsequently coated on the film. If the amount of the aromatic carboxylic acid (anhydride) added is more than 100 pts. wt., the potential life of the coating liquid will be shortened.

The acid or the equivalent that is used is proton acid or the equivalent, or Lewis acid or the equivalent, all of which are soluble in the normal-butylated melamine resin solvent.

The proton acid or the equivalent is a compound that generates protons (H ions) at room temperature or when heated. Organic materials used as the proton acid (equivalent) include organic carboxylic acids or organic carboxylic acid equivalents such as acetic, propionic, caproic, chloroacetic, malonic, acrylic, adipic, sebacic, dodecanedicarboxylic, terephthalic, isophthalic, trimellitic, pyromellitic, naphthalene carboxylic, maleic, fumaric, itaconic, and citraconic acids, and their acid anhydrides and ammonium-salts. Such organic materials also include organic sulfonic acids (for example, paratoluene-sulfonic, dodecylbenzene-sulfonic, and naphthalene-2-sulfonic acids) and their ammonium-salts, and organic phosphoric acids (for example, methylphosphoric and propylphosphoric acids) and their ammonium-salts. In addition, inorganic materials used as the proton acid (equivalent) include sulfuric, phosphoric, and hydrochloric acids and their ammonium-salts, such as sulfuric acid ammonium, phosphoric acid ammonium, and ammonium chloride.

The Lewis acid may be aluminum trichloride, boron trifluoride, tri-methylated boron, and zinc tetrachloride. The total amount of acid (equivalent) added to the normal-butylated melamine resin should preferably be 0.5 to 10 pts. wt. acid (equivalent) per 100 pts. wt. normal-butylated melamine resin. If the amount added is less than 0.5 pts. wt., the hardness of the film will be reduced, resulting in problems such as swelling or dissolution of the film when a charge-generation layer is subsequently coated on the film. If the amount is more than 10 pts. wt., the potential life of the coating liquid will be shortened.

In the present invention, iodine is fixed to a product resulting from reaction of melamine resin and aromatic carboxylic acid (anhydride), or to a reaction product of normal-butylated resin and acid (equivalent). In order to do this, the resulting reaction product is dissolved in an appropriate solvent, and then, iodine of 1 to 20 pts. wt. per 100 pts. wt. reaction product is dissolved in a solvent. The dissolved iodine is then gradually adsorbed and fixed to the reaction product of the melamine resin and aromatic carboxylic acid (anhydride), or the reaction product of the normal-butylated melamine resin, thereby forming a resultant liquid.

Further fixation occurs when the resultant liquid is coated on the substrate and then heated to form a hardened film. Free iodine that has not been fixed is sublimated and removed. If free iodine remains, the initial charged potential may be reduced, the charging ability may be reduced by repeated use, and a memory phenomenon may occur in the images. Therefore, it is necessary to bake the film sufficiently to complete the hardening reaction and completely remove any free iodine. The presence of free iodine can be determined by dipping the hardened film in methanol to check whether or not iodine is being extracted from the film.

Alkyd or phenol resin may be added to the intermediate layer to improve the adhesion of the substrate to the intermediate layer, or the adhesion of the charge-generation layer to the intermediate layer, or, if a thin-film blocking layer containing alcohol-soluble polyamide resin as its main component is formed between the intermediate and the charge-generation layers, to improve the adhesion of the blocking layer to the intermediate layer. Resol-type phenol resin composed of phenol and formaldehyde condensed under an alkali catalyst can be used as the phenol resin.

A filler may be added to the coating liquid, which is subsequently hardened to form the intermediate layer, in order to prevent the coating liquid from dripping, or in the case of the intermediate layer provided in an electro-photography device using coherent light as the exposure light, to prevent moire in images caused by light that is reflected from the substrate. Titanium oxide, aluminum oxide, kaolin, talc or silicone oxide can be used as a filler.

A particularly preferred embodiment of the intermediate layer according to this invention is formed by initially dissolving the above-mentioned alkyd or phenol resin and a filler, along with a mixture of essential ingredients including melamine resin, aromatic carboxylic acid (anhydride) and iodine, in an appropriate solvent to obtain a coating liquid. Alternatively, the mixture of essential ingredients may include normal-butylated melamine resin, acid (equivalent), and iodine. The solvent may be a mixed solvent of xylene and butanol, dichloromethane, methanol, or tetrahydrofuran. It should be noted that the above-mentioned alkyd or phenol resin and filler components are not essential to the present invention.

The conductive substrate is coated with the coating liquid by spraying or dipping, and the coating liquid is heated and hardened to form the resultant intermediate layer. The film may be heated to 80° to 150° C., and should preferably be heated at 120° to 140° C. for 20 to 60 minutes.

The intermediate layer formed in this manner has a sufficiently low and stable electrical resistance that is substantially unaffected by changes in the environment, e.g., changes in humidity or temperature. Even if the intermediate layer has a large film thickness such as 10 to 20 μm, the photoconductor will exhibit superior electrical resistance characteristics, and there will hardly be any variation in the electrical properties such as a decrease in the charge potential or sensitivity, or an increase in the residual potential.

By utilizing the above-mentioned components and methods in forming the intermediate layer, effects of contamination, irregularities in the surface contour and shape, and surface roughness of the conductive substrate can be substantially eliminated, and a uniform photosensitive layer with minimal defects can be formed. In particular, a thin-film charge-generation layer can be easily formed without encountering non-uniform film growth, even when a function-separated, laminated photoconductor, which has a photosensitive layer composed of a charge-transfer layer positioned on top of a charge-generation layer, is manufactured. As a result, it will be possible to obtain a photoconductor that will reliably provide superior images with few defects.

As described above, this invention is particularly effective for use in connection with a function-separated, laminated photoconductor having a photosensitive layer composed of a charge-transfer layer laminated on top of a charge-generation layer. In such a photoconductor, a charge-generation layer is formed by dispersing a pigment such as a copper phthalocyanine, an anthanthrone, a perylene, a perinone, an azo, or a disazo pigment in a solution in which an appropriate binder resin has been dissolved. The resulting mixture is applied on the intermediate layer, and subsequently dried, to form a coated film with a thickness of 0.1 to 1 μm.

A charge-transfer layer with a thickness of 5 to 40 μm is formed on the charge-generation layer by dissolving an enamine, a hydrazone, a styryl, or an amine compound and a binder resin that is compatible with such a compound, such as, for example, polycarbonate, polyester, polystyrene, styreneacrylate in an appropriate solvent. The resultant coating liquid is applied on the charge-generation layer.

Resins which may be used for the intermediate layer according to this invention are melamine resin, normal-butylated melamine resin, phenol resin, and alkyd resin.

Melamine resin is synthesized by methylolating and methylene-condensing melamine and an excess amount of formaldehyde in a substantial amount of butanol in the presence of an alkali catalyst, and subsequently butyletherifying the resultant product. The degree of condensation depends upon the amount of formaldehyde and the intensity of the alkali catalyst. However, in general, a condensation product with a number-average molecular weight of 2000 to 4000 will be produced. If a reaction is caused by using only an acid catalyst, a condensation product with a number-average molecular weight of about 1000 will be obtained.

Melamine resin manufactured in this manner has long been known, and commercially available products include U-VAN (manufactured by Mitsui Toatsu chemicals, Inc.) and SUPER BECKAMINE (manufactured by Dainippon Ink & Chemicals, Inc.).

Normal-butylated melamine resin is synthesized by methylolating and methylene-condensing melamine and an excess amount of formaldehyde in a substantial amount of normal-butanol in the presence of an alkali catalyst, and subsequently butyletherifying the resultant product. The degree of condensation depends upon the amount of formaldehyde and the strength of the alkali catalyst. However, in general, a condensation product with a number-average molecular weight of 2000 to 4000 will be produced. If a reaction is caused by using only an acid catalyst, a condensation product with a number-average molecular weight of about 1000 will be obtained.

Normal-butylated melamine resin manufactured in this manner has long been known, and commercially available products include U-VAN 20SB, 20HS, 2020, and 2021 (Mitsui Toatsu Chemicals, Inc.); and SUPER BECKAMINE J-820-60, L-117-60, and L-109-65 (Dainippon Ink & Chemicals, Inc.).

Phenol resin is synthesized by condensing phenol, m-cresol, o-cresol, or p-cresol and an excess amount of formaldehyde in the presence of an acid or an alkali catalyst. However, it is preferable for this invention to use a resol-type phenol resin synthesized in the presence of an alkali catalyst. Commercially available products include PLYOPHEN 5010, 5030-40K, and TD-447; and SUPER BECKACITE 1001 (manufactured by Dainippon Ink & Chemicals, Inc.).

The use of such phenol resin in combination with the above-described melamine or normal-butylated melamine resin further improves the adhesion of the intermediate layer to the conductive substrate. In this case, the ratio of phenol resin to melamine or normal-butylated melamine resin should preferably be 1 to 10 pts. wt. resol-type phenol resin to 100 pts. wt. melamine or normal-butylated melamine resin.

Alkyd resin is obtained by polyesterifying glycerol, phthalic anhydride, and fatty acid via dehydration and condensation by heating. Alkyd resin is classified into oxidized and non-oxidized types according to the fatty acid used, and it is also classified into long and short oil types according to the amount of fatty acid in the resin. The alkyd resin that uses a dry oil such as soybean, linseed, or a long oil such as glycerol fatty acid ester is preferable for use with the melamine or the normal-butylated melamine resin. Commercially available products include BECKOSOL FS-5103-50X and Beckozol J-510 (manufactured by Dainippon Ink & Chemicals, Inc.).

Alkyd resin reacts with the oxygen in the air and hardens. A drying agent is often used to accelerate this reaction. Such a drying agent includes naphthenic acid cobalt, naphthenic manganese, cobalt-acetylacetonate and manganese-acetylacetonate, and can be used in connection with the intermediate layer obtained by adding alkyd resin to melamine or normal-butylated melamine resin. The ratio of alkyd resin to melamine or normal-butylated melamine resin should preferably be 5 to 50 pts. wt. alkyd resin to 100 pts. wt. melamine or normal-butylated melamine resin, and 0.1 to 5 pts wt. drying agent should be added to 100 pts wt. alkyd resin.

The following materials were used to form various embodiments of the intermediate layer according to this invention:

(1) Melamine resin (material "A").

Resin type "A-1" was obtained by reacting a mixture of 126 g of melamine, 400 g of n-butanol, 150 g of paraformaldehyde, and 0.3 g of 1N hydrochloric acid solution at a temperature of 100° C. for two hours. Thereafter, the reaction product was refluxed and dehydrated to distill n-butanol and obtain a resin solution containing solids accounting for 50% in weight.

An analysis of A-1 melamine resin showed that it has a number average molecular weight of 1500, a methylol group of 1.7, and a butylether group of 2.0.

Resin type "A-2" is U-VAN 62 (trade name; manufactured by Mitsui Toatsu Chemicals, Inc.).

(2) Aromatic carboxylic acid or aromatic carboxylic acid anhydride (material "B)

Type "B-1" is phthalic acid, type "B-2" is phthalic anhydride, type "B-3" is trimellitic acid, type "B-4" is trimellitic anhydride, type "B-5" is pyromellitic acid, and type "B-6" is pyromellitic anhydride.

(3) Phenol resin (material "C")

Resin type "C-1" is PLYOPHEN TD-447 (trade name; manufactured by Dainippon Ink & Chemicals, Inc.).

(4) Alkyd resin (material "D")

Resin type "D-1" is BECKOSOL J-510 (trade name; manufactured by Dainippon Ink & chemicals, Inc.).

(5) Titanium oxide (material "E")

Type "E-1" is Rutile-type Titanium Oxide R-820 (trade name; manufactured by Ishihara Sangyo Kaisha, Ltd.).

(6) Silicon oxide (material "F")

Type "F-1" is Hydrophobic Silica Gel R-212 (trade name; manufactured by Nippon Aerosil Inc.).

(7) Normal-butylated melamine resin (material "G")

Resin type "G-1" was obtained by reacting a mixture of 126 g of melamine, 400 g of normal-butanol, 150 g of paraformaldehyde, and 0.3 g of 1N hydrochloric acid solution at a temperature of 100° C. for two hours. Thereafter, the reaction product was refluxed and dehydrated to distill normal-butanol and obtain a resin solution containing solids accounting for 50% in weight.

An analysis of this normal-butylated melamine resin showed that it has a number average molecular weight of 1500, a methylol group of 1.7, and a butylether group of 2.0.

Resin type "G-2" is U-VAN 20HS (trade name; manufactured by Mitsui Toatsu Chemicals, Inc.).

(8) Acid or acid equivalent (material "H")

Type "H-1" is adipic acid, type "H-2" is ammonium acetate, type "H-3" is ammonium chloride, type "H-4" is ammonium sulfate, type "H-5" is ammonium phosphoric, type "H-6" is paratoluenesulfonic acid, and type "H-7" is aluminum trichloride.

Embodiment Set 1 and Comparative Example Set 1

Formation of the intermediate layer

An intermediate layer was formed on an aluminum cylinder with an outside diameter of 30 mm, an inside diameter of 28 mm, a length of 260.5 mm, and a surface roughness of 1.0 μm at the maximum height $R_{max}$. As shown in Table 1, coating liquids designated T-1 to T-7 were manufactured by using materials A to F and a mixture of xylene (1 pt. wt.) and butanol (1 pt. wt.), and these coating liquids were then dip-coated on the aluminum cylinder. After touch-free drying, the resultant films were baked and hardened to form intermediate layers U-1 to U-7, shown in Table 2, under the conditions outlined in Table 2. The presence of free iodine was determined by dipping the resulting intermediate layer in methanol for a whole day and night, and then measuring the methanol liquid by using the starch method.

For the sake of comparison, coating liquids designated t-1 to t-4, having the composition as shown in Table 1, were manufactured and dip-coated on the aluminum cylinder. After touch-free drying, the resultant films were baked and hardened to form intermediate layers u-1 to u-4 under the conditions outlined in Table 2.

Manufacturing the photoconductors

A liquid mixture manufactured by using a paint shaker to mix 1 pt. wt. X-type non-metal phthalocyanine (manufactured by Dainippon Ink & Chemicals, Inc.; trade name "FASTOGEN BLUE 8120B"), 1 pt. wt. vinyl chloride reaction compound copolymerized resin (manufactured by Nippon Zeon, Ltd.; trade name "MR-110"), and 100 pts. wt. methylene chloride was dip-coated on each of the aluminum cylinders having the above-described intermediate layers to form a charge-generation layer having a dry thickness of 0.2 μm. Thereafter, a coating liquid manufactured by dissolving 10 pts. wt. polycarbonate resin (manufactured by Mitsubishi Gas Chemical Co.; trade name "IUPILON PCZ-300") and 10 pts. wt. N, N-diethylaminobenzaldehydediphenylhydrazone in 80 pts. wt. tetrahydrafuran was dip-coated on the charge-generation layer to form a charge-transfer layer with a dry thickness of 20 μm. In this manner, photoconductors of Embodiment Set 1, designated "Embodiment 1-1" to "Embodiment 1-7" (corresponding to intermediate layers U-1 to U-7, respectively), and photoconductors of Comparative Example Set 1, designated "Comparative Example 1-1" to "Comparative Example 1-4" (corresponding to intermediate layers u-1 to u-4, respectively), were prepared.

Evaluation of the photoconductors

The properties of each photoconductor manufactured in the above-described manner were evaluated using a photosensitive-process testing machine. The photoconductors were installed in the testing machine and charged to -600 V by means of corotron while being rotated at a peripheral speed of 78.5 mm/sec. The electric potential measured while light was not being irradiated was referred to as dark space potential $V_O$. Subsequently, the electric potential was measured after the photoconductor was left in this dark space for five minutes to determine the electric potential retention $V_{k5}$ (%) during that period. Thereafter, light with a wavelength of 780 nm and an irradiance of 2 μW/cm$^2$ was irradiated, and the electric potential measured 0.2 seconds later was referred to as light space potential $V_i$. Furthermore, the electric potential measured after 1.5 seconds of irradiation was referred to as residual potential $V_r$. A cyclical process consisting of charging and exposure as described above was repeated 10,000 times, and the properties of the photoconductor were measured after the 1st and 10,000th processes.

Table 3 shows that the photoconductor of Comparative Example 1-1, which does not contain iodine in the intermediate layer, has a high residual potential and poor repeatability. The photoconductor of Comparative Example 1-3, which contains iodine but has some remaining free iodine, indicates a very poor repeatability. The photoconductor of Comparative Example 1-2, which uses aliphatic carboxylic acid instead of aromatic carboxylic acid (anhydride), has low sensitivity ($V_i$ is high) and poor repeatability. These results clearly show the superiority of the present invention which has an intermediate layer containing as the main components aromatic carboxylic acid (anhydride) and fixed iodine.

Furthermore, these photosensitive properties were measured in a cold and dry environment ("L. L" condition; temperature=10° C., and relative humidity=50%) and in a hot and humid environment ("H. H" condition; temperature=35° C., and relative humidity=85%) to determine the degree of dependency on the environment. Table 4 clearly shows that in a photoconductor that has no iodine fixed in the intermediate layer, $V_O$ and $V_i$ change significantly when the environment changes. In addition, if the photoconductor contains little aromatic carboxylic acid (anhydride), $V_i$ varies sharply.

Subsequently, these same photoconductors were installed in a laser beam printer (manufactured by Hewlett-Packard Co.; trade name "LaserJet III"), and printing was performed in a cold and dry environment ("L.L" condition), in a normal temperature and humidity environment ("N. N" condition; temperature=25° C., and relative humidity=50%), and in a hot and humid environment ("H. H" condition) to evaluate the image quality of the 1st and 10,000th printed sheets. The results are shown in Table 5.

The image quality was evaluated based on the number of black points with a diameter of 0.2 mm or greater present in a 90×90 mm square on the surface of the photoconductor. The results are indicated as follows: if there were less than five points, "◙" was indicated. If there were more than 5 and less than 20 points "○" was indicated. If there were more than 20 and less than 50 points, "▲" was indicated. If there were more than 50 points, "X" was indicated.

Table 5 shows that the photoconductors of the various embodiments of Embodiment Set 1 exhibit a superior image quality and very little image-quality degradation as a function of changes in the environmental conditions or as a function of repeated printing. Contrastingly, the photoconductors of the Comparative Example Set 1 did exhibit image-quality degradation as a function of changes in the environmental conditions or as a function of repeated printing.

Embodiment Set 2 and Comparative Example Set 2

Formation of the intermediate layer

Several variations of an intermediate layer were formed on an aluminum cylinder with an outside diameter of 30 mm, an inside diameter of 28 mm, a length of 260.5 mm, and a surface roughness of 4.0 μm at maximum height $R_{max}$. Coating liquids T-8 to T-15, which have the respective composition as shown in Table 6, were manufactured by using materials C to H and a mixture of xylene (1 pts. wt.) and butanol (1 pts. wt.). Thereafter, these coating liquids were dip-coated on the aluminum cylinder. After touch-free drying, the resultant films were baked and hardened under the conditions outlined in Table 7 to form intermediate layers U-8 to U-15.

For the sake of comparison, coating liquids t-5 to t-8, which have the respective compositions as shown in Table 6, were manufactured by using melamine resins other than normal-butylated melamine resin as indicated below, and thereafter these liquids were dip-coated on the above-described aluminum cylinder. After touch-free drying, the resultant films were baked and hardened under the conditions outlined in Table 7 to form intermediate layers u-5 to u-8.

The melamine resins used to form the coating liquids t-5 to t-8 are listed below:

Isobutylated melamine resin

Type "a-1" is U-VAN 62 (trade name; manufactured by Mitsui Toatsu Chemicals, Inc.), and type "a-2" is SUPER BECKAMINE TD-139-60 (trade name; manufactured by Dainippon Ink & Chemicals, Inc.).

Normal-butylated benzoguanamine resin

Type "a-3" is SUPER BECKAMINE TD-126 (trade name; manufactured by Dainippon Ink & Chemicals, Inc.).

Normal-butylated benzoguanamine, melamine copolymerized resin

Type "a-4" is U-VAN 91-55 (trade name; manufactured by Mitsui Toatsu Chemicals, Inc.).

Manufacturing the photoconductors

A coating liquid mixture formed by using a paint shaker to mix 1 pt. wt. X-type non-metal phthalocyanine (manufactured by Dainippon Ink & Chemicals, Inc.; trade name "FASTOGEN BLUE 8120B"), 1 pt. wt. vinyl chloride reaction compound copolymerized resin (manufactured by Nippon Zeon, Ltd.; trade name "MR-110"), and 100 pts. wt. methylene chloride, was dip-coated on each of the aluminum cylinders having the above-described intermediate layers (U-8 to U-15, and u-5 to u-8) to form a charge-generation layer with a dry thickness of 0.2 μm.

Subsequently, a coating liquid manufactured by dissolving 10 pts. wt. polycarbonate resin (manufactured by Mitsubishi Gas Chemical Co.; trade name "IUPILON PCZ-300") and 10 pts. wt. N,N-diethylaminobenzaldehydediphenylhydrazone in 80 pts. wt. tetrahydrafuran was dip-coated on the charge-generation layer to form a charge-transfer layer with a dry thickness of 20 μm. In this manner, photoconductors of Embodiment Set 2, designated "Embodiment 2-1" to "Embodiment 2-8" (corresponding to intermediate layers U-8 to U-15, respectively), and photoconductors of Comparative Example Set 2, designated "Comparative Example 2-1" to "Comparative Example 2-4" (corresponding to intermediate layers u-5 to u-8, respectively), were prepared.

Evaluation of the photoconductors

The properties of each photoconductor manufactured in this manner were evaluated using a photosensitive process testing machine, as with the photoconductors of Embodiment Set 1 and Comparative Example Set 1. The results are shown in Table 8. Table 8, which uses the same symbols as in Table 3, shows that a photoconductor that uses a melamine resin other than normal-butylated melamine resin for the intermediate layer exhibits poor initial sensitivity, poor potential retention, and high residual potential, and its properties deteriorate significantly with repeated use.

The properties of these photoconductors (embodiments 2-1 to 2-8 and Comparative Examples 2-1 to 2-4) were measured in a cold and dry environment ("L. L" condition), and in a hot and humid environment ("H. H" condition). The results are shown in Table 9. Table 9 clearly shows that the photoconductors incorporating normal-butylated melamine resin as part of their intermediate layer is superior: their properties are substantially immune from change as a function of change in environmental conditions.

Subsequently, as was done with Embodiment Set 1 and Comparative Example Set 1, these photoconductors (Embodiments 2-1 to 2-8 and Comparative Examples 2-1 to 2-4) were installed in a laser beam printer (manufactured by Hewlett-Packard Co.; trade name "LaserJet III"). Printing was performed in a cold and dry environment ("L. L" condition), in a normal temperature and humidity environment ("N. N" condition), and in a hot and humid environment ("H. H" condition) to evaluate the image qualities of the 1st and 10,000th printed sheets. The results are shown in Table 10.

Table 10, which utilizes the same symbols as in Table 5, shows that the photoconductors of the Embodiment Set 2 have superior and stable image qualities which are substantially immune from change as a function of changes in environment, or as a function of repeated production of images. However, the image quality of the photoconductors of the Comparative Example Set 2 did vary as a function of changes in the environment.

Embodiment 3 and Comparative Example 3

Intermediate layers identical to those incorporated in the photoconductors of Embodiment Set 2 and Comparative Example Set 2 (U-8 to U-15 and u-5 to u-8, respectively) were formed on-an aluminum cylinder with an outside diameter of 60 mm, an inside diameter of 58 mm, a length of 348 mm, and a surface roughness of 0.4 μm at maximum height $R_{max}$. Thereafter, a coating liquid was formed by using a sand mill to disperse 2.1 pts. wt. azo compound having the structure shown in Chemical Formula 1, 1.0 pt. wt. polyvinylacetal (manufactured by Sekisui Chemical Co., Ltd.; trade name "S-LEC KS-1"), 16 pts. wt. methyl ethyl ketone, and 9 pts. wt. cyclohexanone, and subsequently adding 75 pts. wt. methyl ethyl ketone to the mixture. The coating liquid was coated on the intermediate layers to form a charge-generation layer with a dry thickness of 0.2 μm.

Thereafter, a coating liquid containing 10 pts. wt. hydrazone compound having the structure shown in Chemical Formula 2, 10 pts. wt. polycarbonate (manufactured by Mitsubishi Gas Chemical Co.; trade name "IUPILON PCZ-300"), and tetrahydrofuran was coated on the charge-generation layer to form a charge-transfer layer with a dry thickness of 20 μm. In this manner, the photoconductors of Embodiment Set 3, designated "Embodiment 3-1" to "Embodiment 3-8" (corresponding to intermediate layers U-8 to U-15, respectively), and Comparative Example Set 2, designated "Comparative Example 3-1" to "Comparative Example 3-4" (corresponding to intermediate layers u-5 to u-8, respectively), were prepared.

In addition, a photoconductor designated as Comparative Example 3-5, which does not contain an intermediate layer, was formed by applying charge-generation and charge-transfer layers as described above. Furthermore, a photoconductor designated as Comparative Example 3-6 was manufactured by forming an intermediate layer containing nylon (manufactured by Toray Industries, Inc; trade name "CM-8000") and having a film thickness of 0.5 μm, and then forming charge-generation and charge-transfer layers on the intermediate layer as described above.

The photoconductors manufactured in this manner (Embodiments 3-1 to 3-8 and Comparative Examples 3-1 to 3-6) were installed in a commercially available copying machine (manufactured by Matsushita Electric Industrial Co., Ltd.; trade name "FP-3270"), and their properties were evaluated. The initial dark space potential ($V_d$) and the initial light space potential ($V_l$) were specified at −800 V and −100 V, respectively, and the quantity of light (lux.sec) required to shift from −800 V to −100 V by changing the light intensity of the exposure light was defined as the initial sensitivity. The electric potential measured when the photoconductor was exposed to a light of 101 lux.sec was defined as the initial residual potential ($V_r$).

After the electric charge and removal process was repeated 30,000 times under the same process conditions existing when the initial properties were measured, the dark space potential ($V_d$), light space potential ($V_l$), sensitivity, and residual potential ($V_r$) were measured to evaluate variations in the properties after repeated use. The results are shown in Table 11.

Table 11 shows that the photoconductors of Comparative Examples 3-1 to 3-4, which use melamine resin other than normal-butylated melamine resin, exhibit a significant change in properties after repeated use. In addition, sharp variation is also observed in the photoconductor of Comparative Example 3-5, which does not have an intermediate layer, and the photoconductor of Comparative Example 3-6, which uses nylon for the intermediate layer. Both of these examples show a significant change in sensitivity and residual potential.

Finally, images were produced using these photoconductors (Embodiments 3-1 to 3-8 and Comparative Examples 3-1 to 3-6) in a cold and dry environment ("L. L" condition), in a normal temperature and humidity environment ("N. N" condition), and in a hot and humid environment ("H. H" condition), and the 1st and 30,000th images obtained were evaluated. The results are shown in Table 12. Table 12 shows that the Embodiments 3-1 to 3-8 have a superior and stable image quality which is substantially immune from change as a function of changes in the environment, or as a function of repeated image production. However, the image quality of the Comparative Examples 3-1 to 3-6 did vary as a function of changes in the environment.

Chemical Formula 1

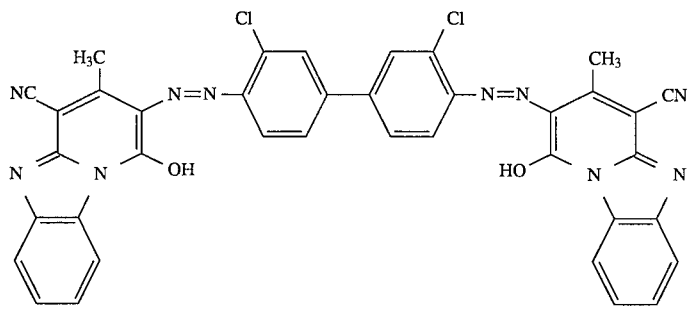

Chemical Formula 2

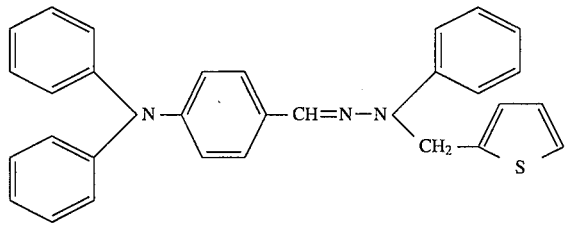

TABLE 1

| Coating liquid number | Intermediate layer coating liquid: Composition of the coating liquid (pts. wt.) Melamine resin | Aromatic carboxylic acid and anhydride | Aliphatic carboxylic acid and anyhdride | Phenol resin, alkyd resin | Iodine | Filler | Concentration (%) |
|---|---|---|---|---|---|---|---|
| T-1 | A-1 (100) | B-1 (20) | | | (6) | | 50 |
| T-2 | A-1 (100) | B-2 (20) | | | (6) | | 50 |
| T-3 | A-1 (100) | B-3 (20) | | | (6) | | 50 |
| T-4 | A-2 (100) | B-4 (20) | | C-1 (5) | (6) | F-1 (10) | 20 |
| T-5 | A-2 (100) | B-5 (20) | | | (6) | | 50 |

TABLE 1-continued

| Coating liquid number | Melamine resin | Aromatic carboxylic acid and anhydride | Aliphatic carboxylic acid and anyhdride | Phenol resin, alkyd resin | Iodine | Filler | Concentration (%) |
|---|---|---|---|---|---|---|---|
| | Intermediate layer coating liquid | | | | | | |
| | Composition of the coating liquid (pts. wt.) | | | | | | |
| T-6 | A-2 (100) | B-6 (20) | | | (6) | | 50 |
| T-7 | A-2 (100) | B-5 (20) | | D-1 (10) | (6) | E-1 (30) | 30 |
| t-1 | A-1 (100) | B-1 (20) | | | (0) | | 50 |
| t-2 | A-1 (100) | | Adipicacid | | (6) | | 50 |
| t-3 | A-2 (100) | B-4 (20) | | | (6) | 20 | |
| t-4 | A-2 (100) | B-4 (10) | Sebatic acid | | (6) | | 30 |

TABLE 2

| Intermediate layer number | Hardening conditions | Film thickness (μm) | Free Iodine |
|---|---|---|---|
| | Intermediate layer | | |
| U-1 | 130° C. × 2 hours | 10 | Absent |
| U-2 | " | 15 | " |
| U-3 | " | 20 | " |
| U-4 | " | 20 | " |
| U-5 | " | 15 | " |
| U-6 | " | 10 | " |
| U-7 | " | 20 | " |
| u-1 | " | 10 | — |
| u-2 | " | 15 | Absent |
| u-3 | 80° C. × 0.5 hours | 15 | Present |
| u-4 | 130° C. × 2 hours | 15 | Absent |

TABLE 3

| | Photoconductor number | After the first process $V_o$ (v) | $V_{KS}$ (%) | $V_i$ (v) | $V_r$ (v) | After the 10,000th process $V_o$ (v) | $V_{KS}$ (%) | $V_i$ (v) | $V_r$ (v) |
|---|---|---|---|---|---|---|---|---|---|
| | | Properties of the photoconductor | | | | | | | |
| EMBODIMENT SET 1 | Embodiment 1-1 | −650 | 94 | −60 | −20 | −640 | 91 | −80 | −25 |
| | Embodiment 1-2 | −660 | 98 | −70 | −25 | −650 | 96 | −79 | −30 |
| | Embodiment 1-3 | −675 | 97 | −65 | −24 | −640 | 94 | −85 | −31 |
| | Embodiment 1-4 | −680 | 96 | −55 | −20 | −650 | 95 | −60 | −30 |
| | Embodiment 1-5 | −675 | 94 | −47 | −23 | −650 | 90 | −55 | −33 |
| | Embodiment 1-6 | −630 | 92 | −75 | −22 | −600 | 88 | −80 | −31 |
| | Embodiment 1-7 | −650 | 97 | −50 | −26 | −610 | 91 | −60 | −30 |
| COMPARATIVE EXAMPLE SET 1 | Comparative example 1-1 | −670 | 96 | −80 | −40 | −600 | 95 | −120 | −60 |
| | Comparative example 1-2 | −650 | 93 | −100 | −70 | −600 | 98 | −180 | −100 |
| | Comparative example 1-3 | −600 | 90 | −40 | −10 | −400 | 70 | −100 | −90 |
| | Comparative example 1-4 | −640 | 94 | −110 | −80 | −600 | 91 | −190 | −90 |

TABLE 4

| Photoconductor number | Properties of the photoconductor | | | | | | | |
|---|---|---|---|---|---|---|---|---|
| | L. L environment | | | | H. H environment | | | |
| | $V_o$ (v) | $V_{KS}$ (%) | $V_i$ (v) | $V_r$ (v) | $V_o$ (v) | $V_{KS}$ (%) | $V_i$ (v) | $V_r$ (v) |
| Embodiment 1-1 | −660 | 94 | −118 | −40 | −640 | 91 | −30 | −15 |
| Embodiment 1-2 | −685 | 94 | −110 | −50 | −645 | 93 | −31 | −17 |
| Embodiment 1-3 | −670 | 92 | −100 | −32 | −635 | 90 | −31 | −14 |
| Embodiment 1-4 | −680 | 97 | −110 | −45 | −650 | 94 | −30 | −12 |
| Embodiment 1-5 | −640 | 93 | −115 | −55 | −620 | 90 | −32 | −10 |
| Embodiment 1-6 | −638 | 92 | −120 | −80 | −615 | 89 | −29 | −11 |
| Embodiment 1-7 | −620 | 93 | −105 | −70 | −620 | 90 | −20 | −9 |
| Comparative example 1-1 | −690 | 98 | −160 | −70 | −590 | 89 | −50 | −39 |
| Comparative example 1-2 | −700 | 96 | −200 | −120 | −600 | 90 | −60 | −40 |
| Comparative example 1-3 | −650 | 97 | −140 | −80 | −550 | 85 | −0 | −9 |
| Comparative example 1-4 | −710 | 99 | −190 | −110 | −600 | 96 | −80 | −50 |

TABLE 5

| Photoconductor number | Image quality | | | | | |
|---|---|---|---|---|---|---|
| | First printed sheet | | | 10,000th printed sheet | | |
| | L. L | N. N | H. H | L. L | N. N | H. H |
| Embodiment 1-1 | ◙ | ◙ | ○ | ○ | ○ | ○ |
| Embodiment 1-2 | ◙ | ◙ | ○ | ○ | ○ | ○ |
| Embodiment 1-3 | ◙ | ◙ | ○ | ○ | ○ | ○ |
| Embodiment 1-4 | ◙ | ◙ | ○ | ○ | ○ | ○ |
| Embodiment 1-5 | ◙ | ◙ | ○ | ○ | ○ | ○ |
| Embodiment 1-6 | ◙ | ◙ | ○ | ○ | ○ | ○ |
| Embodiment 1-7 | ◙ | ◙ | ○ | ○ | ○ | ○ |
| Comparative example 1-1 | Low density | ◙ | Fog | Fog | Fog | Fog |
| Comparative example 1-2 | Low density | Fog | Fog | Low density; fog present | | |
| Comparative example 1-3 | Memory | Memory | Memory | Impossible to evaluate | | |
| Comparative example 1-4 | ○ | ○ | ▲ | Low density; fog present | | |

TABLE 6

| Coating liquid number | Composition of the coating liquid (pts. wt.) Normalbutylated melamine resin | Acid, equivalent | Phenol resin alkyd resin | Iodine | Filler | Intermediate layer coating liquid (%) |
|---|---|---|---|---|---|---|
| T-8 | G-1 (100) | H-1 (2.0) | | (6) | | 50 |
| T-9 | G-1 (100) | H-2 (3.0) | | (6) | | 50 |
| T-10 | G-1 (100) | H-3 (0.7) | | (6) | | 50 |
| T-11 | G-2 (100) | H-4 (0.7) | C-1 (5) | (6) | F-1 (10) | 20 |
| T-12 | G-2 (100 | H-5 (1.0) | | (6) | | 50 |
| T-13 | G-2 (100) | G-6 (3.0) | | (6) | | 50 |
| T-14 | G-2 (100) | H-5 (1.5) | D-1 (10) | (6) | E-1 (30) | 30 |
| T-15 | G-2 (100) | H-7 (4.0) | | (6) | | 50 |
| t-5 | a-2 (100) | H-1 (2.0) | | (6) | | 50 |
| t-6 | a-3 (100) | H-4 (0.7) | | (6) | | 20 |
| t-7 | a-4 (100) | H-4 (0.7) | | (6) | | 30 |
| t-8 | a-1 (100) | H-3 (0.7) | | (6) | | 30 |

TABLE 7

| Intermediate layer number | Hardening conditions | Film thickness (μm) | Intermediate layer Free Iodine |
|---|---|---|---|
| U-8 | 130° C. × 1 hour | 10 | Absent |
| U-9 | " | 5 | " |
| U-10 | " | 10 | " |
| U-11 | " | 10 | " |
| U-12 | " | 5 | " |
| U-13 | " | 10 | " |
| U-14 | " | 10 | " |

TABLE 7-continued

| Intermediate layer number | Hardening conditions | Film thickness (μm) | Intermediate layer Free Iodine |
|---|---|---|---|
| U-15 | " | 5 | " |
| u-5 | " | 10 | " |
| u-6 | " | 5 | " |
| u-7 | " | 5 | " |
| u-8 | " | 5 | " |

TABLE 8

| | Photoconductor number | Properties of the photoconductor: After the first process $V_o$ (v) | $V_{KS}$ (%) | $V_i$ (v) | $V_r$ (v) | After the 10,000th process $V_o$ (v) | $V_{KS}$ (%) | $V_i$ (v) | $V_r$ (v) |
|---|---|---|---|---|---|---|---|---|---|
| EMBODIMENT SET 2 | Embodiment 2-1 | −590 | 93 | −40 | −9 | −570 | 90 | −45 | −21 |
| | Embodiment 2-2 | −570 | 91 | −45 | −10 | −550 | 90 | −50 | −25 |
| | Embodiment 2-3 | −588 | 90 | −51 | −8 | −571 | 88 | −56 | −18 |
| | Embodiment 2-4 | −600 | 94 | −43 | −6 | −590 | 89 | −49 | −22 |
| | Embodiment 2-5 | −610 | 93 | −42 | −7 | −595 | 90 | −50 | −25 |
| | Embodiment 2-6 | −590 | 95 | −40 | −5 | −580 | 92 | −51 | −15 |
| | Embodiment 2-7 | −595 | 94 | −50 | −12 | −579 | 91 | −61 | −26 |
| | Embodiment 2-8 | −605 | 93 | −47 | −8 | −590 | 90 | −56 | −24 |
| COMPARATIVE EXAMPLE SET 2 | Comparative example 2-1 | −570 | 78 | −90 | −50 | −500 | 50 | −90 | −90 |
| | Comparative example 2-2 | −560 | 79 | −85 | −48 | −490 | 61 | −100 | −100 |
| | Comparative example 2-3 | −555 | 83 | −70 | −60 | −480 | 63 | −80 | −80 |
| | Comparative example 2-4 | −560 | 86 | −100 | −80 | −490 | 69 | −110 | −110 |

TABLE 9

| Photoconductor number | Properties of the photoconductor | | | | | | | |
|---|---|---|---|---|---|---|---|---|
| | L. L environment | | | | H. H environment | | | |
| | $V_o$ (v) | $V_{KS}$ (%) | $V_i$ (v) | $V_r$ (v) | $V_o$ (v) | $V_{KS}$ (%) | $V_i$ (v) | $V_r$ (v) |
| Embodiment 2-1 | −610 | 94 | −60 | −10 | −580 | 90 | −30 | −5 |
| Embodiment 2-2 | −590 | 93 | −67 | −11 | −560 | 90 | −47 | −4 |
| Embodiment 2-3 | −600 | 94 | −70 | −13 | −581 | 89 | −50 | −5 |
| Embodiment 2-4 | −620 | 96 | −80 | −10 | −590 | 89 | −41 | −4 |
| Embodiment 2-5 | −625 | 97 | −77 | −16 | −600 | 88 | −49 | −8 |
| Embodiment 2-6 | −605 | 98 | −70 | −14 | −577 | 90 | −45 | −6 |
| Embodiment 2-7 | −608 | 96 | −65 | −20 | −581 | 89 | −50 | −10 |
| Embodiment 2-8 | −600 | 97 | −65 | −21 | −590 | 90 | −49 | −5 |
| Comparative example 2-1 | −590 | 81 | −120 | −100 | −540 | 65 | −80 | −80 |
| Comparative example 2-2 | −585 | 83 | −110 | −90 | −520 | 80 | −90 | −90 |
| Comparative example 2-3 | −580 | 89 | −120 | −105 | −500 | 59 | −74 | −74 |
| Comparative example 2-4 | −590 | 90 | −150 | −130 | −510 | 56 | −100 | −100 |

TABLE 10

| Photoconductor number | Image quality | | | | | |
|---|---|---|---|---|---|---|
| | First printed sheet | | | 10,000th printed sheet | | |
| | L. L | N. N | H. H | L. L | N. N | H. H |
| Embodiment 2-1 | ◉ | ◉ | ○ | ○ | ○ | ○ |
| Embodiment 2-2 | ◉ | ◉ | ○ | ○ | ○ | ○ |
| Embodiment 2-3 | ◉ | ◉ | ○ | ○ | ○ | ○ |
| Embodiment 2-4 | ◉ | ◉ | ○ | ○ | ○ | ○ |
| Embodiment 2-5 | ◉ | ◉ | ○ | ○ | ○ | ○ |
| Embodiment 2-6 | ◉ | ◉ | ○ | ○ | ○ | ○ |
| Embodiment 2-7 | ◉ | ◉ | ○ | ○ | ○ | ○ |

TABLE 10-continued

| Photoconductor number | Image quality | | | | | |
|---|---|---|---|---|---|---|
| | First printed sheet | | | 10,000th printed sheet | | |
| | L. L | N. N | H. H | L. L | N. N | H. H |
| Embodiment 2-8 | ◉ | ◉ | ○ | ○ | ○ | ○ |
| Comparative example 2-1 | Low density | | | Thick fog | | |
| Comparative example 2-2 | " | | | " | | |
| Comparative example 2-3 | " | | | " | | |
| Comparative example 2-4 | | | | | | |

TABLE 11

| | Photoconductor number | Properties of the photoconductor: After the first process $V_d$ (v) | $V_t$ (v) | Sensitivity | $V_r$ (v) | After 30,000 process $V_d$ (v) | $V_t$ (v) | Sensitivity | $V_r$ (v) |
|---|---|---|---|---|---|---|---|---|---|
| EMBODIMENT SET 3 | Embodiment 3-1 | −800 | −100 | 1.00 | −30 | −790 | −85 | 1.00 | −40 |
| | Embodiment 3-2 | −800 | −100 | 0.95 | −27 | −784 | −90 | 1.00 | −30 |
| | Embodiment 3-3 | −800 | −100 | 0.85 | −35 | −778 | −91 | 0.95 | −40 |
| | Embodiment 3-4 | −800 | −100 | 0.96 | −34 | −783 | −88 | 0.91 | −45 |
| | Embodiment 3-5 | −800 | −100 | 0.87 | −26 | −791 | −87 | 0.81 | −30 |
| | Embodiment 3-6 | −800 | −100 | 0.90 | −28 | −785 | −93 | 0.87 | −31 |
| | Embodiment 3-7 | −800 | −100 | 0.91 | −14 | −790 | −89 | 0.81 | −24 |
| | Embodiment 3-8 | −800 | −100 | 0.91 | −20 | −780 | −91 | 0.79 | −40 |
| COMPARATIVE EXAMPLE SET 3 | Comparative example 3-1 | −810 | −100 | 0.87 | −26 | −700 | −70 | 0.85 | −30 |
| | Comparative example 3-2 | −820 | −100 | 0.89 | −70 | −650 | −90 | 0.99 | −90 |
| | Comparative example 3-3 | −830 | −100 | 0.99 | −80 | −670 | −91 | 1.15 | −98 |
| | Comparative example 3-4 | −800 | −100 | 0.91 | −91 | −600 | −91 | 1.45 | −92 |
| | Comparative example 3-5 | −800 | −100 | 0.95 | −94 | −790 | −98 | 1.51 | −99 |
| | Comparative example 3-6 | −800 | −100 | 0.80 | −21 | −778 | −90 | 1.45 | −100 |

TABLE 12

| Photoconductor number | Image quality: First image obtained L. L | N. N | H. H | 30,000th image obtained L. L | N. N | H. H |
|---|---|---|---|---|---|---|
| Embodiment 3-1 | ◉ | ◉ | ◉ | ○ | ◉ | ○ |
| Embodiment 3-2 | ◉ | ◉ | ○ | ○ | ◉ | ○ |
| Embodiment 3-3 | ◉ | ◉ | ○ | ○ | ◉ | ○ |
| Embodiment 3-4 | ◉ | ◉ | ○ | ○ | ◉ | ○ |
| Embodiment 3-5 | ◉ | ◉ | ○ | ○ | ◉ | ○ |
| Embodiment 3-6 | ◉ | ◉ | ○ | ○ | ◉ | ○ |
| Embodiment 3-7 | ◉ | ◉ | ○ | ○ | ◉ | ○ |
| Embodiment 3-8 | ◉ | ◉ | ○ | ○ | ◉ | ○ |
| Comparative example 3-1 | ◉ | ◉ | ○ | Thick fog | | |
| Comparative example 3-2 | ◉ | ◉ | ○ | " | | |

TABLE 12-continued

| Photoconductor number | Image quality: First image obtained L. L | N. N | H. H | 30,000th image obtained L. L | N. N | H. H |
|---|---|---|---|---|---|---|
| Comparative example 3-3 | ◉ | ◉ | ○ | " | | |
| Comparative example 3-4 | ◉ | ◉ | ○ | " | | |
| Comparative example 3-5 | ○ | ◉ | Black spots | Many black spots | | |
| Comparative example 3-6 | ○ | ◉ | Black spots | Thick fog | | |

We claim:

1. An electrophotographic element comprising:

a conductive substrate;

a photosensitive layer; and an intermediate layer positioned between the conductive substrate and the photosensitive layer;

wherein the intermediate layer comprises an intermediate-layer material comprising iodine bound to a product resulting from the reaction of a melamine resin and a material selected from the group consisting of aromatic carboxylic acid and aromatic carboxylic acid anhydride.

2. The electrophotographic element according to claim 1, wherein:

the aromatic carboxylic acid comprises a material selected from the group consisting of terephthalic acid, isophthalic acid, trimellitic acid, pyromellitic acid, and naphthalene carboxylic acid; and the aromatic carboxylic acid anhydride comprises a material selected from the group consisting of phthalic anhydride, trimellitic anhydride and pyromellitic anhydride.

3. The electrophotographic element according to claim 2, wherein:

5 to 100 parts weight of the material selected from the group consisting of aromatic carboxylic acid and aromatic carboxylic acid anhydride is added to 100 parts weight of the melamine resin; and 1 to 20 parts weight iodine is added to 100 parts weight of mixture of melamine resin and the material selected from the group consisting of aromatic carboxylic acid and aromatic carboxylic acid anhydride.

4. The electrophotographic element according to claim 1, wherein the intermediate layer further comprises a filler material and a material selected from the group consisting of alkyd resin and phenol resin.

5. The electrophotographic element according to claim 4, wherein the filler material comprises a material selected from the group consisting of titanium oxide, aluminum oxide, kaolin, talc and silicone oxide.

6. The electrophotographic element according to claim 4, wherein:

5 to 100 parts weight of the material selected from the group consisting of aromatic carboxylic acid and aromatic carboxylic acid anhydride is added to 100 parts weight of the melamine resin; and 1 to 20 parts weight iodine is added to 100 parts weight of mixture of melamine resin and the material selected from the group consisting of aromatic carboxylic acid and aromatic carboxylic acid anhydride.

7. An electrophotographic element comprising:

a conductive substrate;

a photosensitive layer; and an intermediate layer positioned between the conductive substrate and the photosensitive layer;

wherein the intermediate layer comprises an intermediate-layer material comprising iodine bound to a product resulting from reaction of normal-butylated melamine resin and a material selected from the group consisting of an acid and an acid equivalent.

8. The electrophotographic element according to claim 7, wherein:

the acid comprises a material selected from the group consisting of organic carboxylic acid, organic sulfonic acid, organic phosphoric acid, sulfuric acid, phosphoric acid, and hydrochloric acid; and the acid equivalent comprises a material selected from the group consisting of acid anhydride of organic carboxylic acid, ammonium salt of organic carboxylic acid, ammonium salt of organic sulfonic acid, ammonium salt of organic phosphoric acid, ammonium salt of sulfuric acid, ammonium salt of phosphoric acid, ammonium salt of hydrochloric acid, aluminum trichloride, boron trifluoride, tri-methylated boron and zinc tetrachloride.

9. The electrophotographic element according to claim 8, wherein:

0.5 to 10 parts weight of the material selected from the group consisting of acid and acid equivalent is added to 100 parts weight of normal-butylated melamine resin; and 1 to 20 parts weight iodine is added to 100 parts weight of mixture of normal-butylated melamine resin and the material selected from the group consisting of acid and acid equivalent.

10. The electrophotographic element according to claim 7, wherein the intermediate layer further comprises a filler material and a material selected from the group consisting of alkyd resin and phenol resin.

11. The electrophotographic element according to claim 10, wherein the filler material comprises a material selected from the group consisting of titanium oxide, aluminum oxide, kaolin, talc and silicone oxide.

12. The electrophotographic element according to claim 10, wherein:

0.5 to 10 parts weight of the material selected from the group consisting of acid and acid equivalent is added to 100 parts weight of normal-butylated melamine resin; and 1 to 20 parts weight iodine is added to 100 parts weight of mixture of normal-butylated melamine resin and the material selected from the group consisting of acid and acid equivalent.

* * * * *

UNITED STATES PATENT AND TRADEMARK OFFICE

CERTIFICATE OF CORRECTION

PATENT NO. : 5,556,728

DATED : September 17, 1996

INVENTOR(S) : Nogami et al.

It is certified that error appears in the above-identified patent and that said Letters Patent is hereby corrected as shown below:

Column 15, TABLE 1-continued, Coating liquid number t-3, "20" should appear under "Concentration (%)" instead of "Filler";

Column 17, TABLE 4, Comparative Example 1-3, penultimate column, "-0" should read --0--;

Column 19, TABLE 6, Coating liquid number T-12, "G-2 (100" should read --G-2 (100)--;

Column 19, TABLE 6, Coating liquid number T-13, under "Acid, equivalent", "G-6 (3.0)" should read --H-6 (3.0)--.

Signed and Sealed this

Eighth Day of April, 1997

*Attest:*

Bruce Lehman

BRUCE LEHMAN

*Attesting Officer*

*Commissioner of Patents and Trademarks*